US006742857B2

(12) United States Patent
Koshikawa et al.

(10) Patent No.: US 6,742,857 B2
(45) Date of Patent: Jun. 1, 2004

(54) LIQUID CONTAINER AND INK JET RECORDING APPARATUS EMPLOYING LIQUID CONTAINER

(75) Inventors: Hiroshi Koshikawa, Yokohama (JP); Eiichiro Shimizu, Yokohama (JP); Nobuyuki Hatasa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/256,436

(22) Filed: Sep. 27, 2002

(65) Prior Publication Data

US 2003/0071868 A1 Apr. 17, 2003

(30) Foreign Application Priority Data

Sep. 28, 2001 (JP) ..... 2001/302090

(51) Int. Cl.[7] ..... B41J 29/393
(52) U.S. Cl. ..... 347/19
(58) Field of Search ..... 347/19, 86, 85, 347/84, 50, 7, 6, 87, 81, 12, 10, 11, 14, 23, 5; 399/12, 13; 400/703

(56) References Cited

U.S. PATENT DOCUMENTS 5,788,388 A * 8/1998 Cowger et al. ..... 347/7
6,130,695 A 10/2000 Childers et al. ..... 347/85

FOREIGN PATENT DOCUMENTS

| | | |
|---|---|---|
| EP | 1092546 | 4/2001 |
| EP | 1114726 | 7/2001 |
| JP | 6-064182 | 3/1994 |

* cited by examiner

*Primary Examiner*—Stephen D. Meier
*Assistant Examiner*—Charles Stewart, Jr.
(74) *Attorney, Agent, or Firm*—Fitzpatrick, Cella, Harper & Scinto

(57) ABSTRACT

A liquid container includes a liquid containing portion having an opening; a liquid supply portion, fixed in the liquid containing portion, for introducing the liquid from the liquid containing portion; an information memory medium accommodating portion, provided in the liquid containing portion, for holding an information memory medium storing information relating to the liquid container, wherein the information memory medium accommodating portion is adapted such that contact surface of the information memory medium held by the information memory medium accommodating portion is opposed to the liquid supply portion and that space is provided between the contact surface and a surface of the liquid containing portion.

11 Claims, 5 Drawing Sheets

LIQUID CONTAINER AND INK JET RECORDING APPARATUS EMPLOYING LIQUID CONTAINER

FIELD OF THE INVENTION AND RELATED ART

The present invention relates to a liquid container for holding liquid such as ink, and an ink jet recording apparatus in which the liquid container is mountable.

Recording apparatuses capable of functioning as a printer, a copying machine, a facsimileing machine, or the like, and recording apparatuses used as an output device for a multifunctional electronic device or work station inclusive of a computer, a wordprocessor, etc., are structured for recording images (inclusive of characters, symbols, etc.,) on recording medium (member on which image is recorded), for example, paper, fabric, plastic sheet, OHP, and the like, based on recording information. Recording apparatuses can be classified into an ink jet group, a wire-dot group, a thermal group, a laser beam group, etc.

Among these various types of recording apparatuses, recording apparatuses of an ink jet type (which hereinafter will be referred to as ink jet recording apparatuses) record images by ejecting ink onto recording medium from their recording means. Thus, they enjoy various advantages. For example, their recording means can be easily made compact, and they are capable of recording a highly precise image at a high speed. They are capable of recording on ordinary paper without requiring the ordinary paper to be specially treated, and are low in operational cost. Further, they are of a non-impact type, being therefore low in noise. Moreover, color images can be easily recorded with the use of a combination of ink jet recording means and a plurality of inks different in color (for example, color inks).

It is true that ink jet recording apparatuses require recording medium (member on which image is recorded) to meet certain conditions in terms of material. In recent years, however, the advancement in the ink jet technologies made it possible to use an ink jet recording apparatus to record images on fabric, leather, non-woven fabric, metal, etc., in addition to paper (inclusive of thin paper and specially treated paper), which is an ordinary recording medium, thin resin plate (OHP), etc.

ink jet recording apparatuses comprise a recording head (ink jet head) having a plurality of microscopic ejection orifices. They record intended images on recording medium (recording paper or the like) by ejecting ink droplets from the microscopic orifices so that the ink droplets land on the recording medium. There are various types of ink jet recording heads. For example, some ink jet heads employ electromechanical transducers such as piezoelectric elements as ejection energy generation elements for generating the energy used for ejecting ink from the ejection orifices, whereas the others employ electro-thermal transducers having a heat generating resistive member. In the case of the latter, ink is heated so that ink droplets are ejected from the ejection orifices.

Also in recent years, the advancement in the software and hardware for computers or the like made it necessary for ink jet recording apparatuses to be capable of outputting color images. Thus, it has been made possible for recording heads (ink jet heads) to record in color. Further, the advancement in the software and hardware for computers or the like made it necessary for ink jet recording apparatuses to be capable of outputting highly precise images. Thus, recording heads (ink jet heads) have been further improved in terms of recording density (density of image or characters), and also, in terms of the change in ink contents, making it possible to form even more precise high quality images. As a result, not only have ink jet recording apparatuses come to be used in large cooperation offices by businessmen and computer specialists, but also they have come to be widely used in homes or small offices for personal businesses by ordinary people.

As is evident from the above description, ink jet recording apparatuses are provided with a liquid supplying system (ink supplying system) for supplying a recording means (recording head) with liquid as recording ink. The liquid supplying system is structured so that ink containers for holding ink can be removably connected to the liquid supplying system. More specifically, the ink containers as liquid containers can be removably (exchangeably) mounted in the ink container mounting portion provided in ink jet recording apparatuses.

Regarding ink containers such as those one described above, there have been made various proposals. According to one of the proposal, the ink container (liquid container) used for the ink supplying system of the ink jet recording apparatus is equipped with information storage medium so that various information concerning the ink container can be exchanged between the control circuit of the main assembly of the ink jet recording apparatus and the ink container.

For example, Japanese Laid-open Patent Application 2000-218818 discloses an ink container equipped with a storage element capable of storing information such as the amount of the ink remaining in the ink container, production date of the ink container, expiration data of the ink within the container, etc. Japanese Laid-open Patent Application 10-217809 discloses an ink container equipped with information storage medium, which stores various information, is placed in a recess in the bottom portion of the ink cartridge.

As information storage media for liquid containers such as the above described ink container, however, semiconductor elements are widely used. Therefore, there have been technical problems. For example, even if only a few liquid droplets leak when mounting a liquid container into a recording apparatus or the like, or dismounting it therefrom, the few droplets come into contact with the information storage medium and short-circuit it; in other words, the information storage mediums are likely to be damaged.

Further, the electrodes of the information storage media of the ink containers in accordance with prior arts are exposed, being therefore unprotected from ink droplet adhesion. In addition, exposed information storage media are inconvenient in that they are likely to be mechanically (physically) damaged by the static electricity which occurs when ink containers are handled by users, and due to the adhesion of the sweat which also occurs when ink container are handled by users.

It is true that there have been proposals (Japanese Laid-open Patent Application 10-217509, for example), according to which ink containers in accordance with the prior arts are structured so that the information storage medium is placed in a recess. This structural arrangement for the ink container in accordance with the prior arts definitely reduces the possibility that the information storage medium will be mechanically damaged when the ink container is handled by users. However, if ink leaks even by a minute amount during ink container exchange or the like, the leaked ink is likely to come into contact with the electrodes of the information storage medium, resulting in the same inconvenience as the above described one. In other words, it has been difficult to prevent the above described problems.

SUMMARY OF THE INVENTION

The present invention was made in view of the technical problems described above, and its primary object is to provide a liquid container which is equipped with an information storage medium, and is capable of physically protect the information storage medium; is capable of preventing liquid from coming into contact with the information storage medium and connector, even if liquid leaks during the mounting or dismounting of the liquid container, or during the like situations; and is capable of preventing the information storage medium and the components in the adjacencies thereof from becoming damaged due to liquid adhesion.

The present invention is characterized in that in order to accomplish the above described objects, a liquid container comprising: a liquid storage portion having an opening; a liquid outlet portion fixed to the liquid storage portion to draw liquid from the liquid storage portion; and an information storage medium holding portion with which the liquid storage portion is provided to hold an information storage medium for storing the information regarding the liquid container, is structured so that the contact surface of the information storage medium held to the information storage medium holding portion faces toward the liquid outlet portion, and also, so that a space is provided between the contact surface of the information storage medium and the surface of the liquid storage portion.

According to the other characteristic aspects of the present invention, it is preferable that a liquid container in accordance with the present invention is structured so that the space between the contact surface of the information storage medium and the surface of the liquid storage portion constitutes a connector insertion space; the space between the contact surface of the information storage medium and the surface of the liquid storage portion is a recess or cavity provided in the information storage medium holding portion; the information storage medium is solidly fixed to the internal surface of the recess or cavity of the information storage medium holding portion, on the side opposite to the liquid outlet portion; the space between the contact surface of the information storage medium and the surface of the liquid storage portion is enabled to capture liquid; a liquid trapping portion for trapping liquid is provided between the information storage medium holding portion and liquid storage portion; and the information storage medium is positioned higher than the liquid outlet portion, when the liquid container is actually in use.

Another Claim of the present invention is characterized in that an ink jet recording apparatus which records images by ejecting ink onto recording medium from the recording means is provided with a liquid container mounting portion in which a liquid container equipped with an information storage medium structured as described above is mountable.

Therefore, it is possible to provide ink jet recording apparatuses capable of physically protecting an information storage medium; capable of preventing liquid from coming into contact with the information storage medium, even if liquid leaks out of liquid containers during the mounting or dismounting of the liquid containers, or during the like situations; and capable of preventing the information storage medium and the components in the adjacencies thereof from becoming damaged due to liquid adhesion.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be concretely described with reference to the appended drawings. Throughout the drawings, the same referential codes represent the same or equivalent components.

Figure 1:
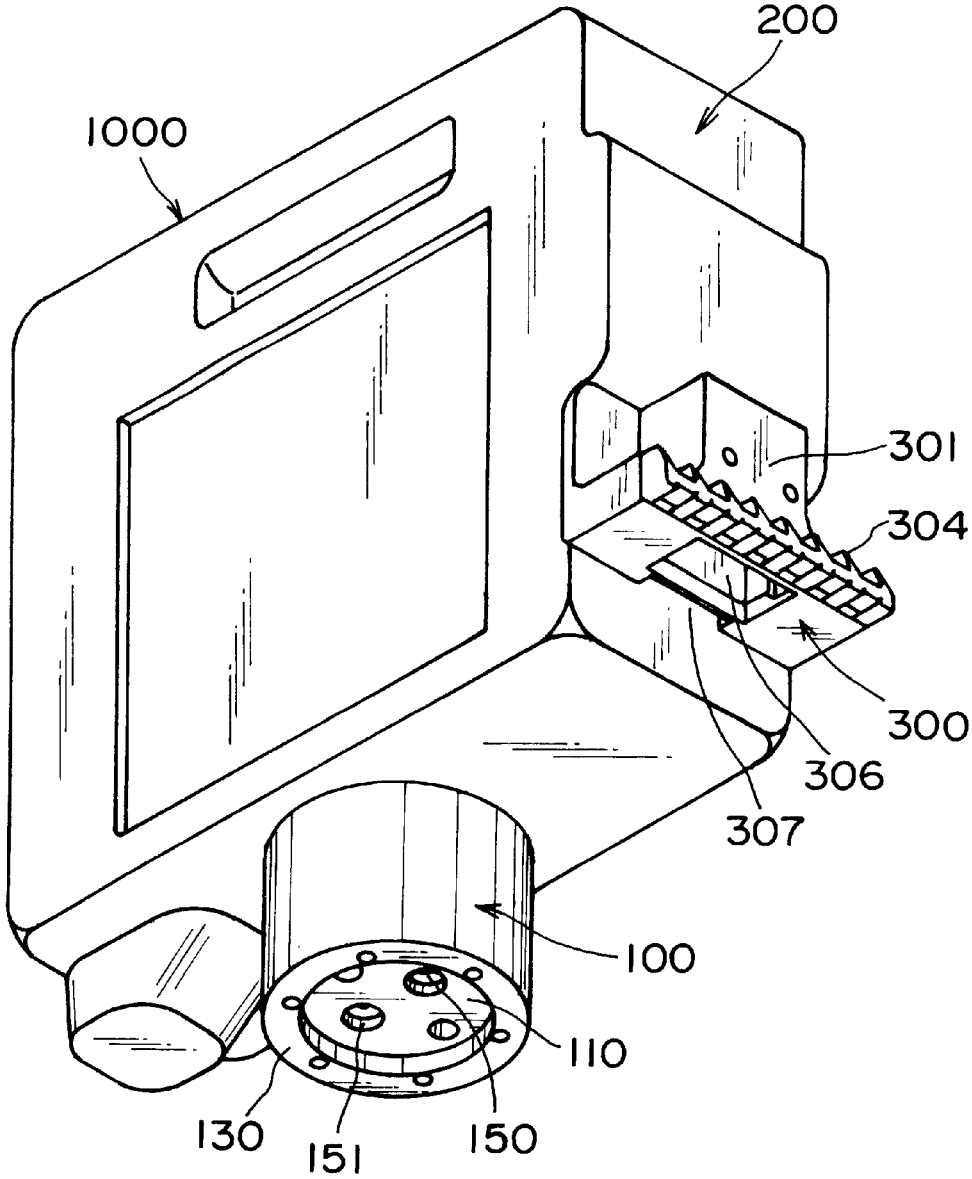
FIG. 1 is a schematic perspective view of an example of a liquid container in accordance with the present invention.
Figure 2:
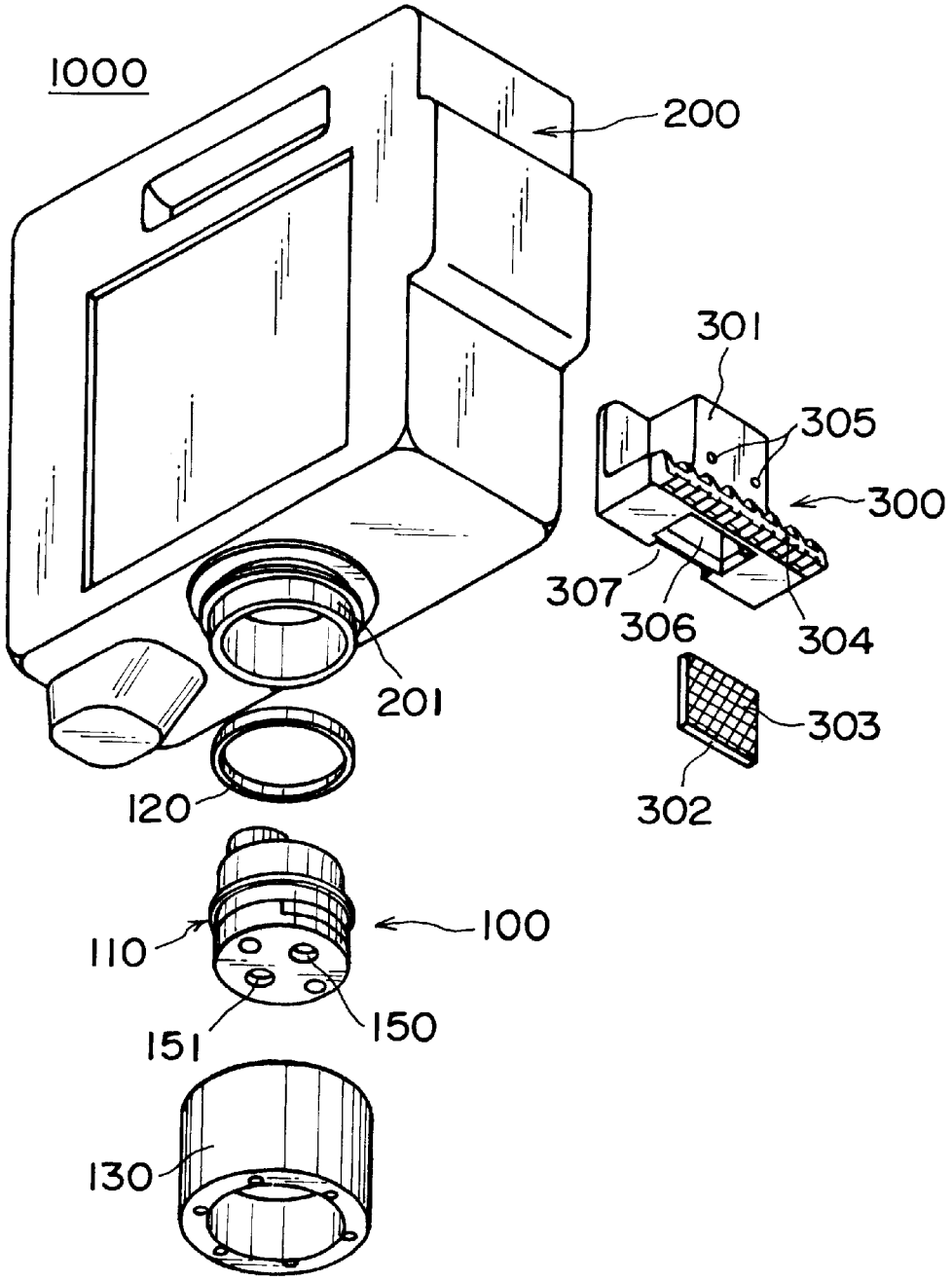
FIG. 2 is an exploded schematic perspective view of the liquid container depicted in FIG. 1, for showing the structure thereof.
Figure 3:
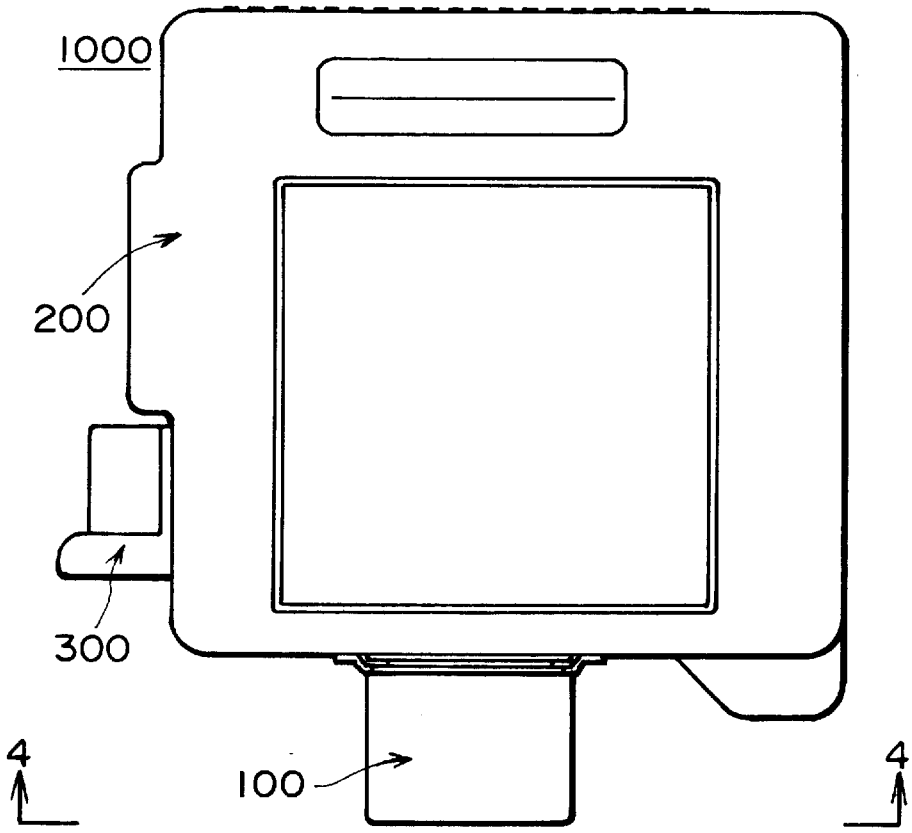
FIG. 3 is a schematic front view of the liquid container depicted in FIG. 1.
Figure 4:
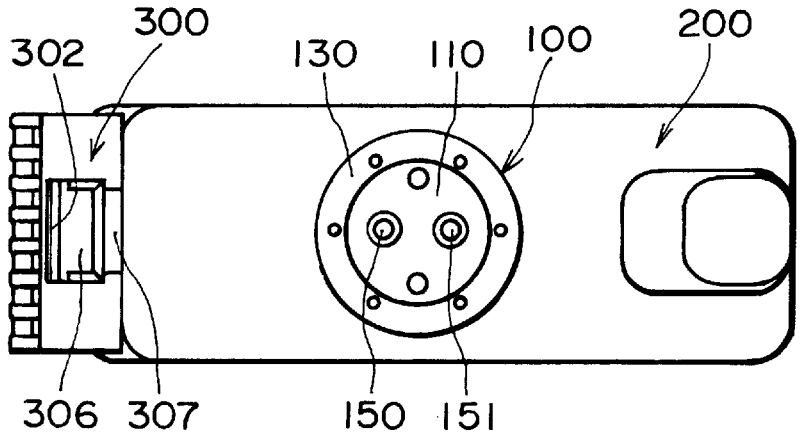
FIG. 4 is a schematic bottom view of the liquid container depicted in FIG. 1, as seen from the side indicated by the line 4—4 in FIG. 3.

FIG. 1 is a schematic perspective view of an example of a liquid container in accordance with the present invention, and FIG. 2 is an exploded schematic perspective view of the liquid container depicted in FIG. 1, for showing the structure thereof. FIG. 3 is a schematic front view of the liquid container depicted in FIG. 1, and FIG. 4 is a schematic bottom view of the liquid container depicted in FIG. 1, as seen from the side indicated by the line 4—4 in FIG. 3.

Referring to FIGS. 1–4, a liquid container 1000 comprises a liquid storage portion 200 which is a hollow container for holding liquid, a liquid outlet portion 100 fixed to the bottom portion of the liquid storage portion 200, and an information storage medium holding portion 300 which is fixed to the liquid storage portion 200, or is formed as an integral part of the liquid storage portion 200 by molding.

The liquid outlet portion 100 is solidly fixed to the bottom surface of the liquid storage portion 200 by being screwed onto the liquid outlet portion 100, with the interposition of a sealing member 120, so that the connecting unit 110 is placed in contact with the bottom surface of the liquid storage portion 200, being aligned with the liquid outlet portion 100. More specifically, the peripheral surface of the spout portion of the liquid outlet portion 100 is provided with male threads, whereas the internal surface of a capping member 130 is provided with female thread. Thus, as the capping member 130 is screwed onto the spout portion of the liquid outlet portion 100, the connecting unit 110 is firmly held to the bottom surface of the liquid storage portion 200, being sandwiched between the sealing member 130 and liquid storage portion 200. As a result, a liquid outlet portion 100 is solidly fixed to the liquid storage portion 200. The top surface of the capping member 130 is provided with an opening through which connecting portions 150 and 151 of the connecting unit 110 are exposed.

The liquid container 1000 is mounted into an ink jet recording apparatus or the like, with the connecting portions 150 and 151 of its liquid outlet portion 100 facing downward, and is used in this posture. In other words, when the liquid container 1000 is an ink container for an ink jet recording apparatus, it is removably mounted into the liquid container mounting portion of an ink jet recording apparatus so that the connecting portions 150 and 151 face downward to supply the ink jet head (recording head) as the recording means of the ink jet recording apparatus with ink.

The information storage medium holding portion 300 is fixed to the external surface of one of the lateral walls of the liquid storage portion 200, being positioned so that it will be positioned higher than the liquid outlet portion 100. The information storage medium 302 is pasted, with the use of a piece of two-sided adhesive tape, to the information storage medium holder 301 of the information storage medium holding portion 300. In this embodiment, the information storage medium holder 301 is provided with an ID portion 304 (mechanical identifying portion), which comprises a plurality of projections and is used for preventing the liquid container 1000 from being erroneously mounted into an ink jet recording apparatus or the like.

The portion of the information storage medium holder 301, to which the information storage medium 302 is fixed (pasted), is a part of the internal surface of the hollow 306 (cavity) formed in the information storage medium holder 301, on the side opposite to the liquid outlet portion 100. The hollow 306 constitutes the connector plug insertion hole into which the connector plug on the apparatus main assembly side is inserted to establish electrical connection between the information storage medium 302 and the apparatus main assembly. The information storage medium 302 is solidly fixed to a predetermined portion of the information storage medium holder 301, being accurately positioned relative to the information storage medium holder 301 by a positioning hole 305 provided in the wall of the connector plug insertion hole 306.

In this embodiment, the information storage medium holding portion 300 is fixed to the external surface of one of the lateral walls of the liquid storage portion 200 (container) with the use of ultrasonic welding or the like method. Also in this embodiment, a portion of the internal surface of the connector plug insertion hole 306, that is, a recess or hollow formed in the information storage medium holder 301, which is on the side opposite to the liquid outlet portion 100, is selected as the portion to which the information storage medium 302 is fixed. Therefore, a sufficient distance is provided between the information storage medium 302 and the surface of the liquid storage portion 200 to which the information storage medium holding portion 303 is welded, preventing the information storage medium 302 from being damaged (physically) by the vibrations which occurs during the ultrasonic welding of the information storage medium holder 301 to the liquid storage portion 200. Further, the information storage medium 302 is placed in the connector plug insertion hole 306, that is, a recess or hollow of the information storage medium holding portion 300. Therefore, the information storage medium 302 is prevented from being damaged by the static electricity generated as the ink container is handled by a user, and the adhesion of sweat which occurs also as the ink container is handled by a user, and also, the information storage medium 302 is prevented from being mechanically damaged by the physical collision of the information storage medium 302 with the surroundings.

The information storage medium 302 is such an information storage medium that is capable of exchanging information with an ink jet recording apparatus after the mounting of the liquid container 1000, such as an ink container, into the ink jet recording apparatus. The information exchanged between the information storage medium 302 and ink jet recording apparatus regards the ink expiration date, the amount of the ink remaining in the liquid container 1000, ink color, etc. The control section of the ink jet recording apparatus reads the information regarding these aspects of the ink container, and warns a user of the ink expiration date or ink depletion, urging thereby the user to exchange the current ink container with a fresh one. With this arrangement, it is possible to prevent the changes in ink color and/or viscosity from affecting image quality, and also, to prevent the ink jet recording apparatus from carrying out an image forming operation while the ink container is empty; in other words, it is possible to prevent the formation of defective images. Therefore, it is possible to always carry out a satisfactory image forming operation to output high quality images.

The information storage medium 302 may be virtually any storage medium, for example, a magnetic memory, a magneto-optic memory, an electrical memory, a mechanical memory, etc., as long as identification information can be stored therein, and can be retrieved therefrom by information retrieving means. Further, it may be a flash memory, a magnetic medium such as a WORM, or the like. In this embodiment, an EEPROM, or an electrically erasable programmable read-only memory, is employed as the information storage medium for the liquid container (ink container or the like), which is capable of holding the ink container identification information; into which information can be written from the recording apparatus main assembly side; into which additional information can be written from the recording apparatus main assembly side, to be added to the information pre-existing therein; and, in which the stored information can be altered or erased. This EEPROM is mounted on the substrate for a printed circuit having a contact portion which is to be electrically connected to the electrical connector provided on the recording apparatus main assembly side. The integral combination of these components constitutes the information storage medium 302.

When the liquid container 1000 is an ink container for an ink jet recording apparatus, the ID portion 304 formed of a plurality of projections arranged like the teeth of a comb is used as an ID for preventing the ink container from being erroneously mounted. Predetermined teeth of the ID portion 304 have been removed according to the color of the ink therein, the model of the recording apparatus, etc., whereas the portions of the apparatus main assembly side corresponding to the removed teeth of the ID portion 304 on the ink container side are provided with a projection to assure that only a correct ink container (model, color, etc.) can be mounted.

Referring again to FIGS. 1–4, the information storage medium holding portion 300 is solidly fixed to the external surface of one of the lateral walls of the liquid storage portion 200 (container), being positioned close to the bottom of the liquid storage portion 200. Also in this embodiment, a liquid trapping portion 307 is provided between the information storage medium holding portion 300 and liquid storage portion 200. The liquid trapping portion 307 is a cavity or recess, the opening of which faces downward. It is capable of capturing and retaining liquid. Thus, even if liquid leaks from the liquid outlet portion 100 when mounting or dismounting the liquid container 1000, or during the like situations, the liquid is captured and retained by the liquid trapping portion 307, being thereby prevented from reaching the information storage medium 302 held in the information storage medium holding portion 300.

Figure 5:
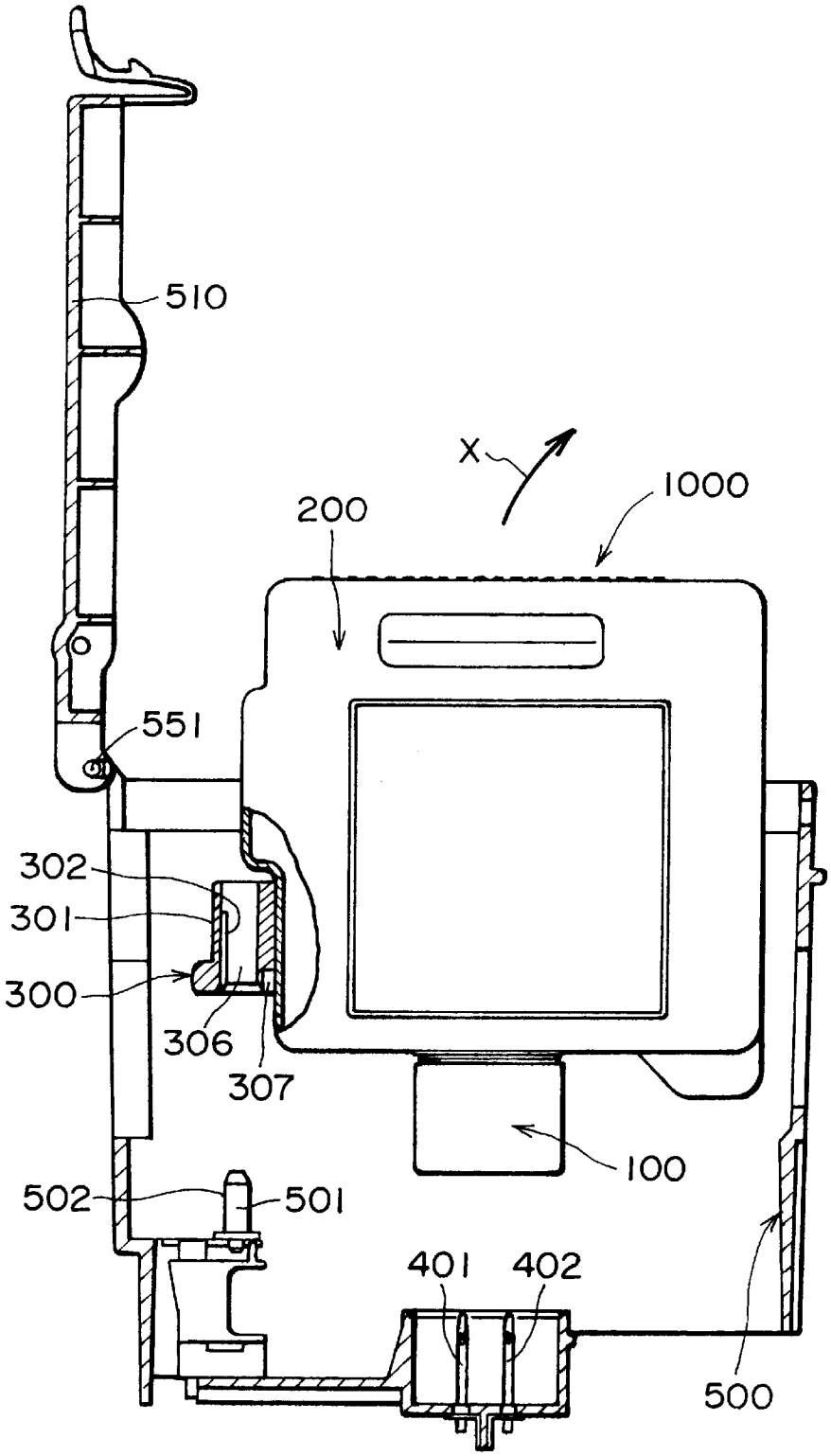
FIG. 5 is a schematic sectional view of the liquid container mounting portion of an ink jet recording apparatus, into which the liquid container depicted in FIG. 1 has been partially mounted.
Figure 6:
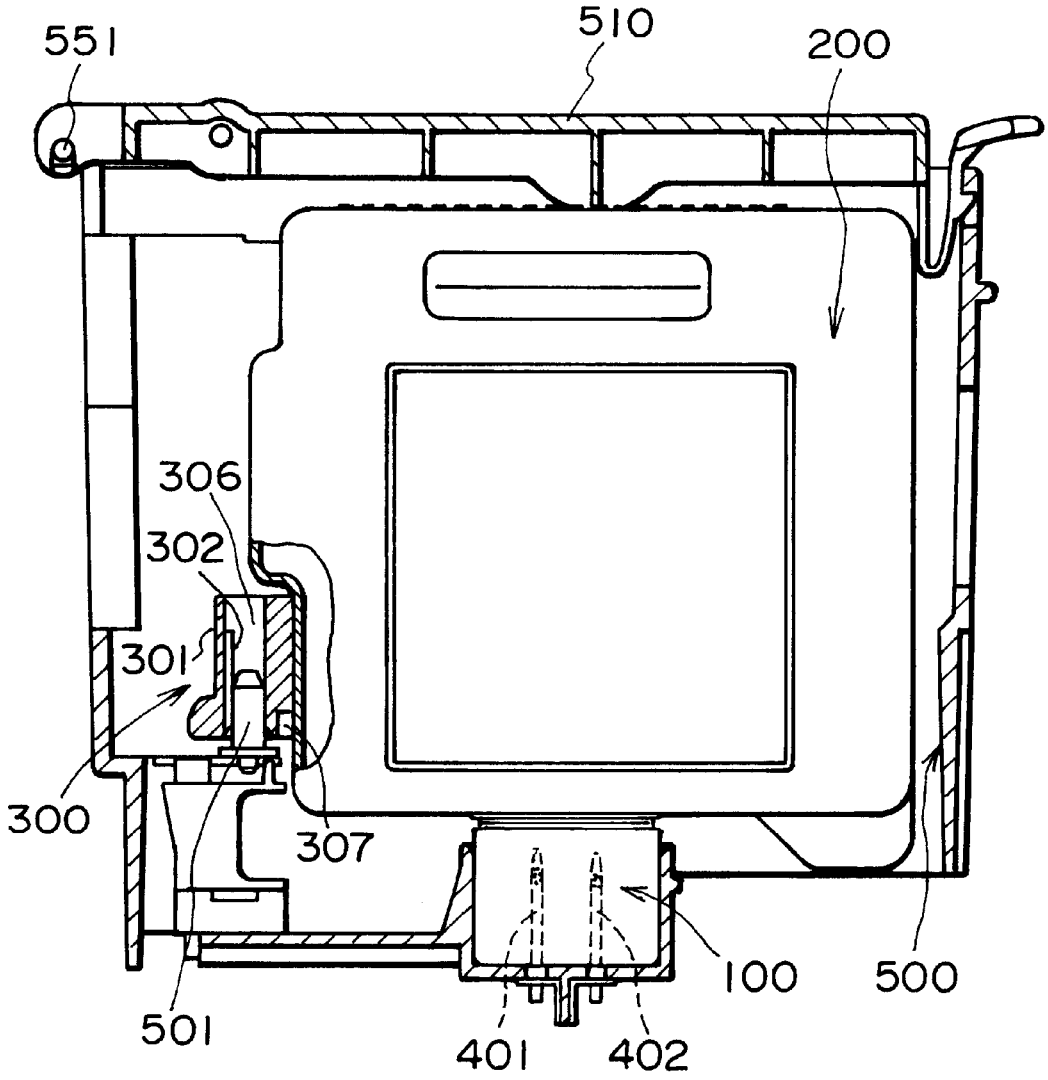
FIG. 6 is a schematic sectional view of the liquid container mounting portion of an ink jet recording apparatus, into which the liquid container depicted in FIG. 1 has been completely mounted.

FIG. 5 is a schematic sectional view of the liquid container mounting portion of an ink jet recording apparatus, into which the liquid container 1000 has been partially mounted, and FIG. 6 is a schematic sectional view of the liquid container mounting portion of an ink jet recording apparatus, into which the liquid container 1000 has been completely mounted.

Referring to FIGS. 5 and 6, the main assembly of the ink jet recording apparatus is provided with a base 500 as the liquid container mounting portion into which the liquid container 1000 is mountable. The base 500 is provided with a liquid drawing hollow needle 401 and an air introducing hollow needle 402, which are within the base 500. These hollow needles 401 and 402 are disposed so that their positions correspond to those of the liquid outlet portion 100 of the liquid container 1000 as the liquid container 1000 is mounted.

The liquid drawing hollow needle 401 is a needle through which the liquid (ink) within the liquid storage portion 200 is supplied to the ink jet head as a recording means, and the air introducing hollow needle 402 is a needle through which the ambient air is introduced into the liquid storage portion 200.

Also located within the base 500 is a connector plug 501 having an electrically connecting portion (contact portion). As the liquid container 1000 is mounted into the liquid container mounting portion of the apparatus main assembly, the connector plug 501 is inserted into the connector plug insertion hole 306 of the information storage medium holding portion 300, becoming therefore electrically connected to the information storage medium 302 (FIG. 6).

The base 500 is provided with an arm 510 (or lever) rotatable about the supporting point 551. As the arm 510 is rotated upward as shown in FIG. 5, the opening of the base 500 becomes unblocked, allowing the liquid container 1000 to be mounted or dismounted (exchanged). As the arm 510 is rotated downward as shown in FIG. 6, it blocks the opening of the base 500, firmly holding the liquid container 1000, in the predetermined posture (mounting posture), to the ink jet recording apparatus.

Referring to FIG. 5, as the arm 510 is rotated to the closed position after the mounting of the liquid container 1000 into the base 500, the liquid container 1000 is pressed down by the arm 510. As a result, the liquid container 1000 is accurately positioned, in the predetermined posture, relative to the ink jet recording apparatus.

Further, as the liquid container 1000 is pressed down by the arm 510, the liquid drawing hollow needle 401 and air introducing hollow needle 402 are made to penetrate the connecting portions 150 and 151 of the liquid outlet portion 100, and reach the internal space of the liquid storage portion 200. At the same time, the connector plug 501 is inserted into the connector plug insertion hole 306 of the information storage medium holding portion 300, establishing electrical connection between the electrically connecting portion 502 of the connector plug 501 and the information storage medium 302.

As a result, it becomes possible for the liquid in the liquid storage portion 200 to be supplied to the ink jet head through the liquid drawing hollow needle 401, liquid supply tube (unshown), etc., and for the ambient air to be introduced into the liquid storage portion 200 through the air introducing hollow needle 402. In addition, it becomes possible for the information about the liquid container 1000 stored in the information storage medium 302 to be transmitted to the control circuit of the recording apparatus main assembly.

According to the above described embodiment of the present invention, the present invention is characterized in that in the liquid container comprising: the liquid storage portion 200 having the sprout 201; liquid outlet portion 100 solidly fixed to the liquid storage portion 200 to draw the liquid from within the liquid storage portion 200; and the information storage medium holding portion 300 with which the liquid storage portion 200 is provided to hold the information storage medium 302 storing the information regarding the liquid container 1000, the information storage medium 302 is held by the information storage medium holding portion 300 so that the contact surface of the information storage medium 302 faces toward the liquid outlet portion 100, and the space 306 is provided between the contact surface of the information storage medium 302 and the surface of the liquid storage portion 200.

With the provision of this structural arrangement, not only can the information storage medium 302 attached to the liquid container 1000 be physically protected, but also even if the liquid within the liquid container 1000 leaks during the mounting or dismounting of the liquid container 1000 or during the like situations, the liquid is prevented from coming into contact with the information storage medium 302 and/or connector plug 501. Therefore, it becomes possible to prevent the information storage medium 302 and the components in the adjacencies thereof from being damaged by the adhesion of the liquid thereto.

Further, in the above described embodiment, the space between the contact surface of the information storage medium 302 and the surface of the liquid storage portion 200 constituted the connector plug insertion hole 306, and this space is a recess or cavity with which the information storage medium holding portion 300 is provided.

Further, the information storage medium 302 is fixed to the internal surface of the recess or cavity 306 of the information storage medium holding portion 300, on the side opposite to the liquid outlet portion 100. The space which constitutes the connector plug insertion hole 306 is enabled to capture and retain liquid. Therefore, as the liquid having leaked from the liquid outlet portion 100 or the like passes by the space, it captures and retains the liquid.

Further, the liquid trapping portion 307 for trapping liquid is provided between the information storage medium holding portion 300 and liquid storage portion 200, adding to the liquid trapping function of the connector plug insertion hole 306 (space).

Referring to FIG. 6, also in the above described embodiment, the ink jet recording apparatus and liquid container 1000 therefor are structured so that when the liquid container 1000 is in use after being mounted into the ink jet recording apparatus, the information storage medium holding portion 300 is positioned higher than the liquid outlet portion 100, and also, so that the information storage medium holding portion 300 is positioned at one of the lengthwise ends of the liquid storage portion 200.

Further, the information storage medium holding portion 300 and liquid storage portion 200 are structured so that they are solidly attached to each other after being formed as discrete components. However, the information storage medium holding portion 300 may be formed as an integral part of the liquid storage portion 200 by molding or the like.

The connecting unit 110 of the liquid outlet portion 100 is provided with two connecting portions: the liquid drawing connecting portion which is to be penetrated by the liquid drawing hollow needle 401, and the air introduction connecting portion which is to be penetrated by the air introducing hollow needle 402. The two connecting portions are within the connecting unit 110, and are provided with a rubbery elastic member, which is placed, in the compressed state, in the two connecting portions to keep the liquid storage portion 200 airtight even after the penetration of the hollow needles through the two connecting portions. In addition, these connecting portions are fitted with an absorbent member so that if liquid leaks out of the liquid storage portion 200 even by a small amount, the liquid is absorbed by the absorbent member.

Further, the liquid storage portion 200 is a hollow container formed of plastic by blow molding.

The above described embodiment of the present invention enjoys the following operational effects.

First, referring to FIG. 6, the information storage medium holding portion 300 is located higher than the liquid outlet portion 100, and is located at one of the lengthwise ends of the liquid storage portion 200. Therefore, should liquid leak from the joint between the liquid outlet portion 100 and connection needle 401, and/or the joint between the liquid outlet portion 100 and connection needle 402, the leaking liquid is prevented from directly coming into contact with the information storage medium 302 and connector plug 501.

Further, the information storage medium 302 is solidly attached (pasted) to the internal surface of the information storage medium holding portion 300, on the side opposite to the liquid outlet portion 100 across the space 306 (connector plug insertion hole). Therefore, should the liquid seeps (leaks) out of the aforementioned joints, and reaches the information storage medium holding portion 300 by way of the surface (bottom and/or lateral surfaces) of the liquid storage portion 200, the liquid is prevented by the space 306 (connector plug insertion hole) between the two portions 300 and 200 from reaching (coming into contact with) the information storage medium 302 and connector plug 501.

Further, with the provision of the above described structural arrangement, it is possible for the electrical contact portion 502 of the connector plug 501 to be placed on the side opposite to the liquid outlet portion 100 across the space 306. Therefore, not only the information storage medium 302 but also the electrical contact portion 502 can be prevented from coming into contact with the liquid.

Moreover, the liquid trapping portion 307 for capturing liquid is provided between the liquid storage portion 200 and information storage medium holding portion 300, adding to the liquid capturing function of the connector plug insertion hole 306.

As described above, in the above described embodiment, the liquid is virtually perfectly prevented from coming into contact with the electrical contact portion 502, by the synergetic effect of the positioning of the information storage medium holding portion 300 relative to the liquid outlet portion 100, the positioning of the point of (pasting point) of the internal surface of the information storage medium holding portion 300 to which the information storage medium 302 is fixed, the presence of the liquid trapping portion 307 within the information storage medium holding portion 300, etc.

The provision of the above described structure for the prevention of the liquid contact makes it necessary for the liquid container 1000 to be moved in the direction indicated by an arrow mark X in FIG. 5 in order to dismount the liquid container 1000 from the base 500. Therefore, the provision of the above described structure is beneficial to the mounting of the liquid container 1000 into the ink jet recording apparatus or the like, and the dismounting of the liquid container 1000 therefrom. To describe in more detail, the information storage medium holding portion 300 and connector plug 501 are solidly attached to the external surface of the liquid storage portion 200 and the internal surface of the liquid container mounting portion, respectively, on the downstream side in terms of the liquid container removal direction (indicated by arrow mark X). Therefore, the liquid outlet portion 100 does-not move over the connector plug 501 during the removal of the liquid container 1000. Therefore, should liquid drips from the liquid outlet portion 100, the liquid does not fall onto the connector plug 501.

Incidentally, in the above described embodiment, the number of the connecting portions provided within the liquid outlet portion 100 (connecting unit 110) was two. However, the number may be one or no less than three.

Also in the above described embodiment, the cross section of the liquid outlet portion 100 was circular. However, the shape of the cross section of the liquid outlet portion 100 is optional. For example, it may be rectangular, elliptical, triangular, or may have any shape other than the preceding ones.

As for the compatibility of the present invention with ink jet recording apparatuses having a liquid container mounting portion into which the above described liquid container 1000 is mountable, the present invention is applicable to various ink jet recording apparatuses, and the application produces effects similar to those described above, regardless of their recording methods. For example, the present invention is compatible with serial type ink jet recording apparatuses which record images by moving the recording head as a recording means in the primary scanning direction, line type ink jet recording apparatuses which record images by moving only in the secondary scanning direction a line type recording head which is long enough to partially or entirely cover the width of recording medium.

Further, the present invention is applicable to various ink jet recording apparatuses regardless of the number of recording heads mounted in the apparatuses. For example, the present invention is compatible with ink jet recording apparatuses employing only a single recording head, color ink jet recording apparatuses employing a plurality of recording heads different in ink color, gradation recording ink jet recording apparatuses employing a plurality of recording heads which are identical in ink color but are different in ink contents, combination ink jet recording apparatuses, that is, those employing a combination of the recording methods of the preceding types of ink jet recording apparatuses, etc., and the application produces the effects similar to those described above.

Moreover, the present invention is applicable to various ink jet recording apparatuses regardless of the positioning of the recording heads and liquid containers (ink containers), and the application produces effects similar to those described above.

As is evident from the above description of the present invention, according to claim 1 of the present invention, the present invention is characterized in that in a liquid container comprising: a liquid storage portion with a spout, a liquid outlet portion solidly fixed to the liquid storage portion to draw liquid from the liquid storage portion; an information storage medium holding portion with which the liquid storage portion is provided to hold an information storage medium storing the information regarding the liquid container, the information storage medium is attached to the information storage medium holding portion so that the contact surface of the information storage medium faces toward the liquid outlet portion, and also, a space is provided between the contact surface of the information storage medium and the surface of the liquid storage portion.

Therefore, it is possible to provide a liquid container which has an information storage medium, and in which the information storage medium is physically protected, and in which even if liquid leaks during the mounting or dismounting of the liquid container, the liquid is prevented from coming into contact with the information storage medium and connector, preventing therefore the information storage medium and the components in the adjacencies thereof from being damaged by the adhesion of the liquid thereto.

According to claim 2–5 of the present invention, the above described ink container is structured so that the space between the contact surface of the information storage medium and the surface of the liquid storage portion constitutes a connector plug insertion hole; the space between the contact surface of the information storage medium and the surface of the liquid storage portion is made up of a recess or cavity provided in the information storage medium holding portion; the information storage medium is solidly fixed to the internal surface of the recess or cavity of the information storage medium holding portion, on the side opposite to the liquid outlet portion; the space between the contact surface of the information storage medium and the surface of the liquid storage portion is enabled to capture liquid.

Therefore, it is possible to provide a liquid container which has an information storage medium, and is capable of physically protecting the information storage medium; capable of more effectively preventing liquid from coming into contact with the information storage medium and connector, even if liquid leaks out of the liquid container during the mounting or dismounting of the liquid container or during the like situations; and capable of preventing the information storage medium and the components in the adjacencies thereof from becoming damaged due to liquid adhesion.

According to claim 2–4 of the present invention, the above described ink container is structures so that a liquid trapping portion for capturing liquid is provided between the information storage medium holding portion and liquid storage portion; the information storage medium holding portion is positioned higher than the liquid outlet portion, while the liquid container is in use; and the information storage medium holding portion is positioned at one of the lengthwise ends of the liquid storage portion.

Therefore, it is possible to provide a liquid container which has an information storage means, and is capable of physically protecting an information storage medium; capable of more effectively preventing liquid from coming into contact with the information storage medium and connector, even if liquid leaks out of the liquid container during the mounting or dismounting of the liquid container or during the like situations; and capable of preventing the information storage medium and the components in the adjacencies thereof from becoming damaged due to liquid adhesion.

According to claim 5–11 of the present invention, the above described ink contain is structured so that the information storage medium holding portion and liquid storage portion are discrete members; the liquid is ink; the liquid outlet portion is provided with the connecting portion through which air is introduced into the liquid container; the liquid outlet portion is penetrated by a liquid drawing hollow needle; the liquid storage portion is a hollow container formed of plastic by blow molding; and the ink container is made removably mountable into an ink jet recording apparatus which records images by ejecting ink from recording means onto a member, onto which images are to be recorded.

Therefore, it is possible to provide a liquid container which has an information storage medium, and is capable of physically protecting an information storage medium; capable of more effectively preventing liquid from coming into contact with the information storage medium and connector, even if liquid leaks out of the liquid container during the mounting or dismounting of the liquid container or during the like situations; and capable of preventing the information storage medium and the components in the adjacencies thereof from becoming damaged due to liquid adhesion.

According to claim 11 of the present invention, an ink jet recording apparatus which records images by ejecting ink onto recording medium from the recording means is provided with a liquid container mounting portion into which a liquid container equipped with an information storage medium structured as described above is mountable.

Therefore, it is possible to provide ink jet recording apparatuses into which a liquid container having an information storage medium is mountable, and which are capable of physically protecting the information storage medium; capable of preventing liquid from coming into contact with an information storage medium, even if liquid leaks out of the liquid container during the mounting or dismounting the liquid container, or during the like situations; and capable of preventing the information storage medium and the components in the adjacencies thereof from becoming damaged due to liquid adhesion.

While the invention has been described with reference to the structures disclosed herein, it is not confined to the details set forth, and this application is intended to cover such modifications or changes as may come within the purposes of the improvements or the scope of the following claims.

What is claimed is:

1. A liquid container comprising:

a liquid containing portion having an opening;

a liquid supply portion, fixed in said liquid containing portion, for introducing the liquid from said liquid containing portion;

an information memory medium accommodating portion, provided in said liquid containing portion, for holding an information memory medium storing information relating to said liquid container, wherein said information memory medium accommodating portion is constructed such that a contact surface of the information memory medium held by said information memory medium accommodating portion is opposed to said liquid supply portion, and such that a space is provided between the contact surface and a surface of said liquid containing portion, wherein the space provides a portion for receiving a connector, and wherein said information memory medium accommodating portion has a recess or cavity for fixing the information memory medium on an inner side opposite said liquid supply portion so that the contact surface of the information memory medium faces said liquid supply portion.

2. A container according to claim 1, wherein the space functions to trap the liquid.

3. A container according to claim 1, wherein a liquid trap portion is provided between said information memory medium accommodating portion and said liquid containing portion.

4. A container according to claim 1, wherein said information memory medium accommodating portion is disposed above said liquid supply portion.

5. A container according to claim 1, wherein said information memory medium accommodating portion and said liquid containing portion are separate members.

6. A container according to claim 1, wherein the liquid is ink.

7. A container according to claim 1, wherein said liquid supply portion has a connecting portion for introducing air into said liquid containing portion.

8. A container according to claim 1, wherein a hollow needle for introducing the liquid is inserted into said liquid supply portion.

9. A container according to claim 1, wherein said liquid containing portion is a hollow container provided by blow molding.

10. A container according to claim 1, wherein said liquid container is detachably mountable to an ink jet recording apparatus which effects recording by ejecting the liquid which is ink onto a recording material from recording means.

11. An ink jet recording apparatus for effecting recording by ejecting ink onto recording means comprising a mounting portion on which said liquid container as defined in claim 1 is detachably mountable.

* * * * *